US008474202B2

(12) United States Patent
Boyer et al.

(10) Patent No.: US 8,474,202 B2
(45) **Date of Patent: *Jul. 2, 2013**

(54) EXTRUDED SEAL PLATE FOR HORIZONTAL INSULATED COMPOSITE ARCHITECTURAL PANEL VERTICAL END JOINTS

(75) Inventors: Keith D. Boyer, Moon Township, PA (US); Richard A. Brow, Venetia, PA (US); Ralph E. Bertram, Pittsburgh, PA (US)

(73) Assignee: Centria, Moon Township, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/494,290

(22) Filed: Jun. 12, 2012

(65) Prior Publication Data

US 2012/0247039 A1 Oct. 4, 2012

Related U.S. Application Data

(63) Continuation of application No. 12/426,575, filed on Apr. 20, 2009, now Pat. No. 8,261,499.

(60) Provisional application No. 61/046,194, filed on Apr. 18, 2008.

(51) Int. Cl.
*E04B 2/62* (2006.01)

(52) U.S. Cl.
USPC ..... 52/235; 52/396.04

(58) Field of Classification Search
USPC ..... 52/396.04, 396.05, 396.08, 396.1, 52/235, 483.1, 460, 463
See application file for complete search history.

(56) References Cited

U.S. PATENT DOCUMENTS

| | | | |
|---|---|---|---|
| 3,844,087 | A | 10/1974 | Schultz et al. |
| 4,506,484 | A | 3/1985 | Bartlett et al. |
| 4,627,208 | A | 12/1986 | Esposito |
| 4,658,559 | A | 4/1987 | Doherty |
| 4,765,107 | A | 8/1988 | Ting |
| 4,996,809 | A | 3/1991 | Beard |
| 5,655,346 | A | 8/1997 | Holmes et al. |
| 5,749,282 | A | 5/1998 | Brow et al. |
| 5,893,245 | A | 4/1999 | Sekiguchi et al. |
| 6,253,511 | B1 | 7/2001 | Boyer |
| 6,627,128 | B1 | 9/2003 | Boyer |
| 6,745,527 | B1 | 6/2004 | Sherman et al. |
| 6,968,659 | B2 | 11/2005 | Boyer |
| 7,007,433 | B2 | 3/2006 | Boyer |
| 7,661,233 | B2 | 2/2010 | Stenvall |

FOREIGN PATENT DOCUMENTS

| | | | |
|---|---|---|---|
| JP | 06002423 | A | 1/1994 |
| JP | 06026187 | A | 2/1994 |
| JP | 06066017 | A | 3/1994 |
| JP | 06136929 | A | 5/1994 |

*Primary Examiner* — Christine T Cajilig
(74) *Attorney, Agent, or Firm* — The Webb Law Firm

(57) ABSTRACT

A seal plate for building panels includes an elongate body having a first side and a second side. The first side of the elongate body includes first and second seals and a recessed channel. The first and second seals and the recessed channel extend at least a portion of the length of the elongate body. The recessed channel is positioned between the first and second seals.

17 Claims, 4 Drawing Sheets

EXTRUDED SEAL PLATE FOR HORIZONTAL INSULATED COMPOSITE ARCHITECTURAL PANEL VERTICAL END JOINTS

CROSS REFERENCE TO RELATED APPLICATIONS

This application is a continuation of U.S. patent application Ser. No. 12/426,575, filed Apr. 20, 2009, which claims priority to U.S. Provisional Application No. 61/046,194, filed Apr. 18, 2008.

BACKGROUND OF THE INVENTION

1. Field of the Invention

The present invention is directed to a vertical joint for composite architectural building panels and, more particularly, to a seal plate for architectural panel vertical end joints.

2. Description of Related Art

Generally, architectural panels in a horizontal orientation are attached to spaced vertical supports secured to exterior building frames. A wall surface is formed by a number of building panels joined together along their sides to form horizontal joints and along their ends to form vertical joints. Each panel typically includes one or more metal facers that encase a homogenous core, such as an insulated foam core. The building panels need to be sealed properly to prevent leaks in the exterior wall structure formed by the building panels. Typically, the seals at the vertical end joints of the building panels have been achieved using a sealant, such as a non-curing butyl, to provide a sealant bead between the inner metal facer and a gage metal seal plate. The gage metal seal plates are generally non-structural, requiring another member to transfer the fastener loads from the panels to the vertical support. The bead of sealant, however, is the only line of defense for sealing the vertical end joint in these prior art designs and leaks can occur if this seal is broken or if connecting beads of sealant are missing between vertical field applied seals and factory seals running the panel length.

SUMMARY OF THE INVENTION

In one embodiment, we have developed a seal plate for building panels which includes an elongate body having a first side and a second side. The first side of the elongate body includes first and second seals and a recessed channel. The first and second seals and the recessed channel extend at least a portion of the length of the elongate body. The recessed channel is positioned between the first and second seals. The first seal may include a gasket receiving portion. Further, the first seal may include a pair of spaced apart gasket receiving portions, each having a recess configured to receive a mounting portion of a gasket. The recessed channel may be connected to an exterior atmosphere such that a pressure within the recessed channel is equalized to the exterior atmosphere. The second seal may include a sealant receiving portion. Further, the second seal may include a pair of spaced apart sealant receiving portions, each having a recessed pocket configured to receive a bead of sealant. The recessed pocket may define a relief gap positioned adjacent to a longitudinal edge of the elongate body. The elongate body may include a metal plate and, more specifically, an aluminum plate configured to transfer loads from the building panels to a support. The seal plate may further include a pair of spaced apart legs extending from the second side of the elongate body, with each leg extending at least a portion of the length of the elongate body. The seal plate may also further include a pair of spaced apart tab members extending from the second side of the elongate body, with each tab member extending at least a portion of the length of the elongate body.

In a further embodiment, we have developed a seal plate assembly for a vertical end joint between first and second building panels, each having a first side and a second side. The seal plate assembly includes an elongate body having a first side and a second side, and an elongate gasket. The first side of the elongate body defines a gasket receiving portion that extends at least a portion of the length of the elongate body. The elongate gasket is positioned on the gasket receiving portion of the elongate body and is configured to engage the second side of the first and second building panels.

The first side of the elongate body may further define a pair of spaced apart sealant receiving portions that extend at least a portion of the length of the elongate body. Each of the sealant receiving portions is positioned inboard from the elongate gasket toward respective longitudinal edges of the elongate body. Each sealant receiving portion may include a recessed pocket configured to receive a bead of sealant, with each recessed pocket defining a relief gap positioned adjacent the longitudinal edge of the elongate body. The elongate body may include a pair of channels extending at least a portion of the length of the elongate body, with each channel positioned between the elongate gasket and a respective longitudinal edge of the elongate body. The gasket receiving portion may include a recess configured to receive a mounting portion of the elongate gasket. The first and second building panels may define a vertical end joint with the seal plate assembly further comprising an exterior gasket positioned within the vertical end joint. Further, the exterior gasket may include an insert disposed on a side of the exterior gasket facing the first side of the first and second building panels.

In another embodiment, we have developed a seal plate for building panels including an elongate body having a first side and a second side. The first side of the elongate body defines a pair of gasket receiving portions, a pair of sealant receiving portions, and a pair of recessed channels. The pair of gasket receiving portions, the pair of channels, and the pair of sealant receiving portions extend the length of the elongate body. Further, each of the recessed channels is positioned between respective gasket receiving portions and sealant receiving portions.

DESCRIPTION OF PREFERRED EMBODIMENTS

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific seal plates illustrated in the accompanying drawing figures and described herein are simply exemplary and should not be considered as limiting.

Figure 1:
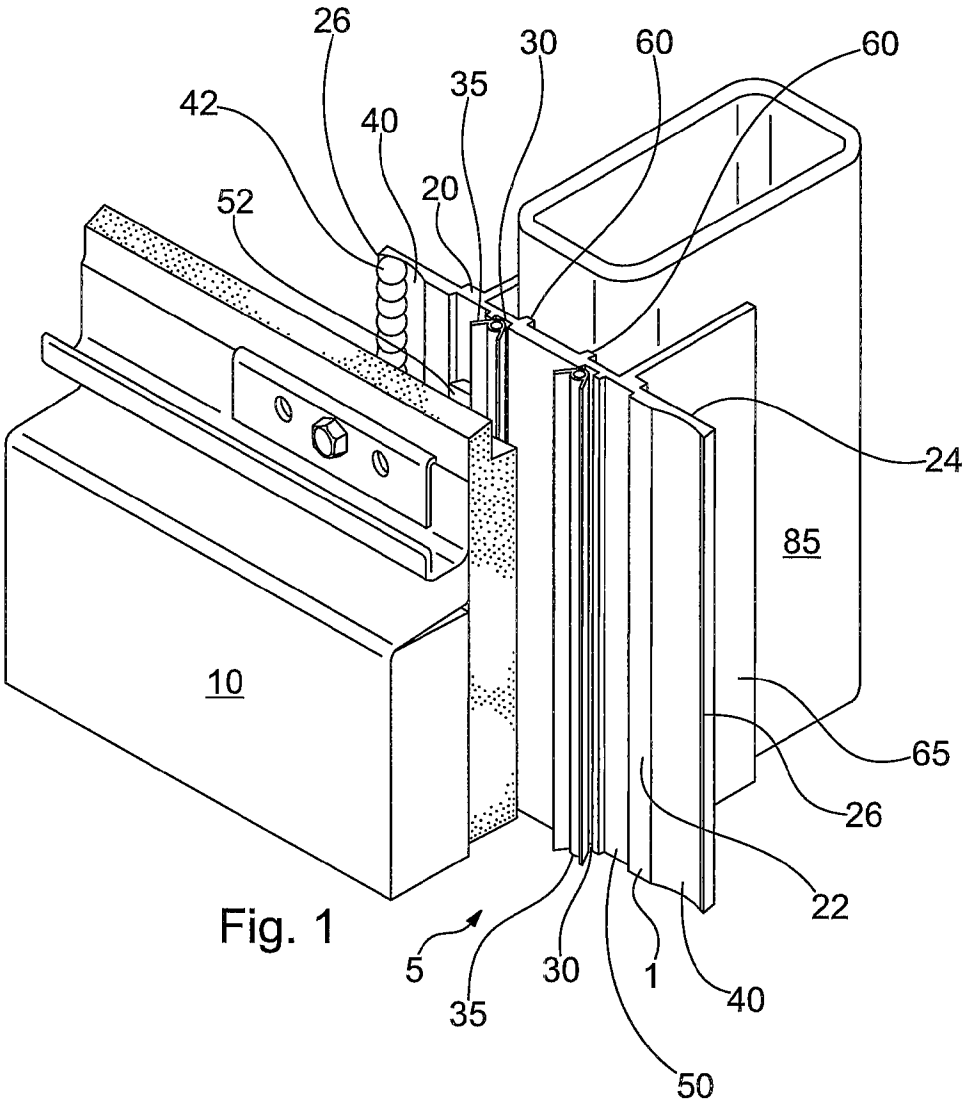
FIG. 1 is a perspective view of a portion of a seal plate according to one embodiment of the present invention, showing the seal plate secured to a tubular support.
Figure 2:
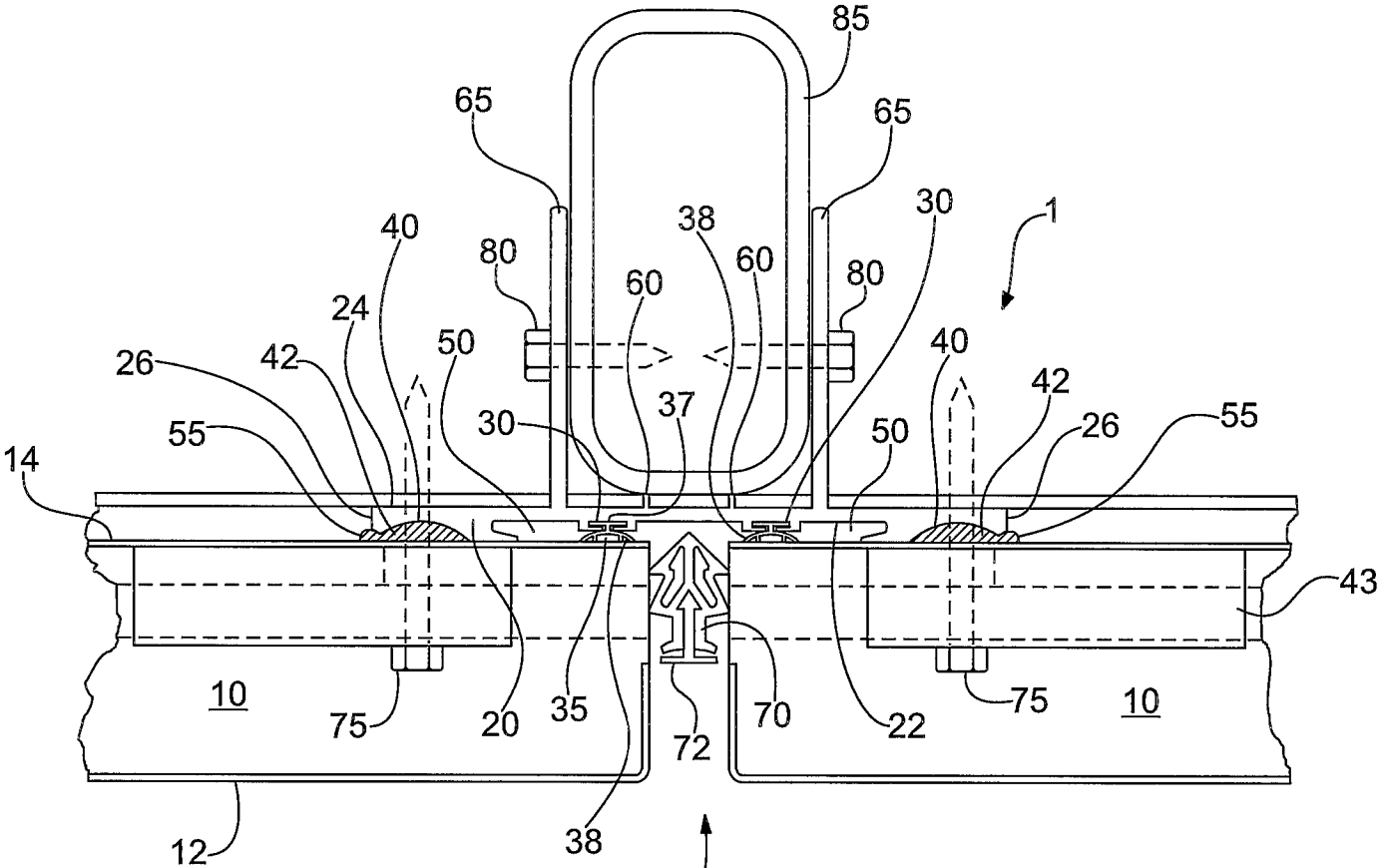
FIG. 2 is a cross-sectional view of the seal plate shown in FIG. 1.

Pursuant to one embodiment and referring to FIGS. 1 and 2, a seal plate assembly 1 for a vertical end joint 5 between adjacent building panels 10 is shown. Each building panel 10, which is shown having a horizontal application, includes a facing sheet 12 and a backing sheet 14. Two building panels 10 define a vertical end joint 5 between the ends of the building panels 10. The seal plate assembly 1, which seals the vertical end joint 5 between the building panels 10, includes an elongate body 20 having a first side 22 and a second side 24. The elongate body 20 may be constructed from metal, such as aluminum, although other suitable materials may be used. Further, the elongate body 20 may be formed through an extrusion process, although other suitable manufacturing techniques may also be used. The first side 22 of the elongate body 20 has a pair of gasket receiving portions 30 positioned on opposite sides of the vertical end joint 5 and extending the length of the elongate body 20. The gasket receiving portions 30 are configured to receive elongate gaskets 35, which also extend the length of the elongate body 20. The gasket receiving portions 30 are disclosed as a T-shaped recess or channel corresponding to a similarly shaped mounting portion 37 of the gaskets 35. In particular, as shown in FIGS. 1 and 2, the gasket 35 is a tubular-type gasket having a pair of arms 38 extending from the gasket 35. Although a T-shaped recess is disclosed as the gasket receiving portion 30, any suitable type of gasket 35 and corresponding gasket receiving portion 30 may be used.

Referring again to FIGS. 1 and 2, the first side 22 of the elongate body 20 further includes a pair of sealant receiving portions 40 positioned on opposite sides of the vertical end joint 5 and extending the length of the elongate body 20. The sealant receiving portions 40 are positioned inboard of the gasket receiving portions 30, i.e., closer to longitudinal edges 26 of the elongate body 20. The sealant receiving portions 40 are disclosed as recessed pockets or concave depressions in the first side 22 of the elongate body 20, which are configured to receive a bead of sealant 42. However, the sealant receiving portions 40 may embody other suitable shapes.

The seal plate assembly 1 further includes a pair of channels 50 located on opposite sides of the vertical end joint 5 and positioned laterally between the sealant receiving portions 40 and the gasket receiving portions 30, and extending the length of the elongate body 20. The channels 50 are recessed from the first side 22 of the elongate body 20. The channels 50 extend to a base detail (not shown) at the bottom of the building panels 10 to allow water or moisture that may bypass the gaskets 35 to drain from the channels 50. Further, the channels 50 are connected to the exterior atmosphere, which equalizes pressure within the channels 50 and prevents water from being drawn across the gaskets 35. The channels 50 may be connected to the exterior atmosphere at the base and head details and also through the horizontal joint of the building panels 10. Although the channels 50 are shown to extend the length of the elongate body 20, the channels 50 may only extend a portion of the length of the elongate body 20 such that the channels 50 still enable venting or draining. A foam baffle block 52 may be placed in the channels 50 at each panel joint to further ensure the channels 50 remain open in the presence of adjacent sealant beads. As described above, the channels 50 are outboard (positioned away from the edges 26 of the elongate body 20) of the sealant receiving portions 40, allowing sealant 42 in the sealant receiving portions 40 and sealant in horizontal seals 43 of the panels 10 to form a substantially air tight seal. Thus, the air tightness of the wall formed by the panels 10 is not compromised by the venting feature of the channels 50 in the seal plate assembly 1.

The first side 22 of the elongate body 20 also includes relief gaps 55 extending along the longitudinal edges 26 of the elongate body 20 adjacent to the sealant receiving portions 40. The relief gaps 55 define a space between the edges 26 of elongate body 20 and the backing sheet 14 of the building panels 10 and ensure that the sealant 42 does not plug the channels 50 as the panels 10 compress the sealant 42. The relief gaps 55 allow excess sealant 42 to be extruded out the edges 26 of the elongate body 20. Further, the relief gaps 55 offer visual inspection to determine if there is enough sealant 42 in the sealant receiving portions 40. If there is insufficient sealant 42 in the sealant receiving portions 40, the relief gaps 55 allow the seal to be repaired by providing additional sealant 42 within the sealant receiving portions 40.

The elongate body 20 also includes a pair of spaced apart extension legs 65 extending from the second side 24 of the elongate body 20 and configured to engage the sides of a tubular support 85. The extension legs 65 extend from the second side 24 of the elongate body 20 at an angle substantially perpendicular to the elongate body 20. Further, the second side 24 of the elongate body 20 includes a pair of spaced apart tab members 60 extending the length of the elongate body 20 for engaging the tubular support 85 and providing a space between the second side 24 of the elongate body 20 and the tubular support 85. The space between the second side 24 of the elongate body 20 and the tubular support 85 allows flashing (not shown) to be installed between the seal plate assembly 1 and the tubular support 85 at the base of the wall formed by the panels 10 by machining or removing a portion of the tab members 60. Thus, the tab members 60 allow flashing to be installed with minimal machining of the elongate body 20 as opposed to machining the second side 24 of the elongate body 20 if the second side 24 was flush with the tubular support 85.

Upon installation of the building panels 10, the extension legs 65 of the elongate body 20, as shown in FIGS. 1 and 2, engage the tubular support 85. The elongate body 20 is secured to the tubular support 85 by a plurality of attachment fasteners 80 inserted through corresponding holes (not shown) in the extension legs 65 and the tubular support 85, although other fastening arrangements may be provided to secure the elongate body 20 to the tubular support 85. The attachment screws 80 may include a gasket between the screw head and the elongate body 20. A bead of sealant 42 is provided in the sealant receiving portions 40 of the elongate body 20. The sealant 42 may be a non-curing butyl sealant; however, other suitable types of sealants may be used. The building panels 10 are then secured to the elongate body 20 by placing the backing sheet 14 of the panels 10 against the first side 22 of the elongate body 20 such that the gaskets 35 in the gasket receiving portions 30 and the sealant 42 are engaged and compressed by the building panels 10. The panels 10 are then secured to the elongate body 20 by a plurality of clamping screws 75 inserted through the panels 10 and corresponding holes (not shown) in the elongate body 20. Thus, the elongate body 20 is structural, allowing the seal plate 1 to transfer fastener loads from the panels 10 to the tubular support 85.

Figure 3:
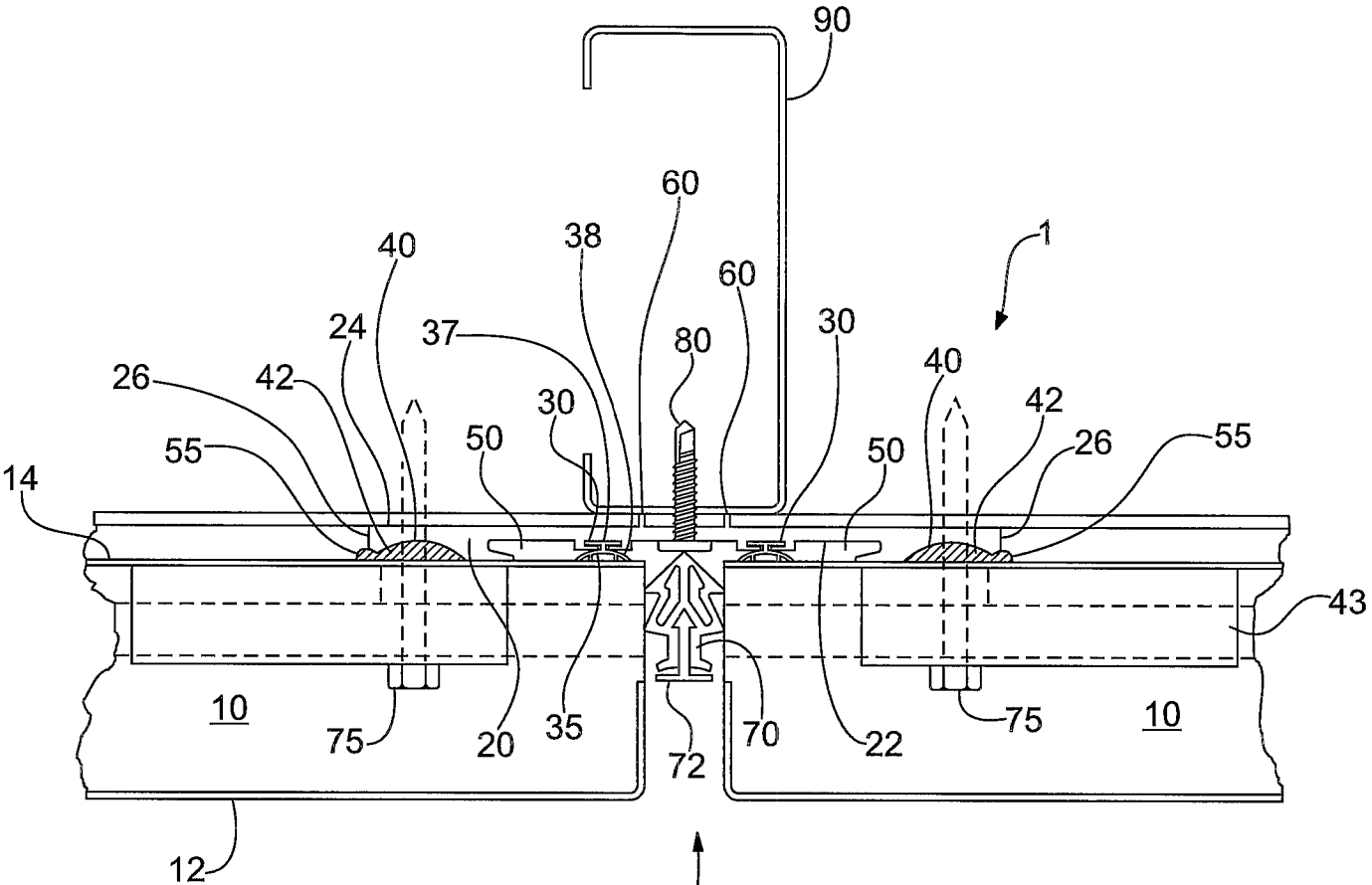
FIG. 3 is a cross-sectional view of a seal plate according to another embodiment of the present invention, showing the seal plate secured to a stud.
Figure 4:
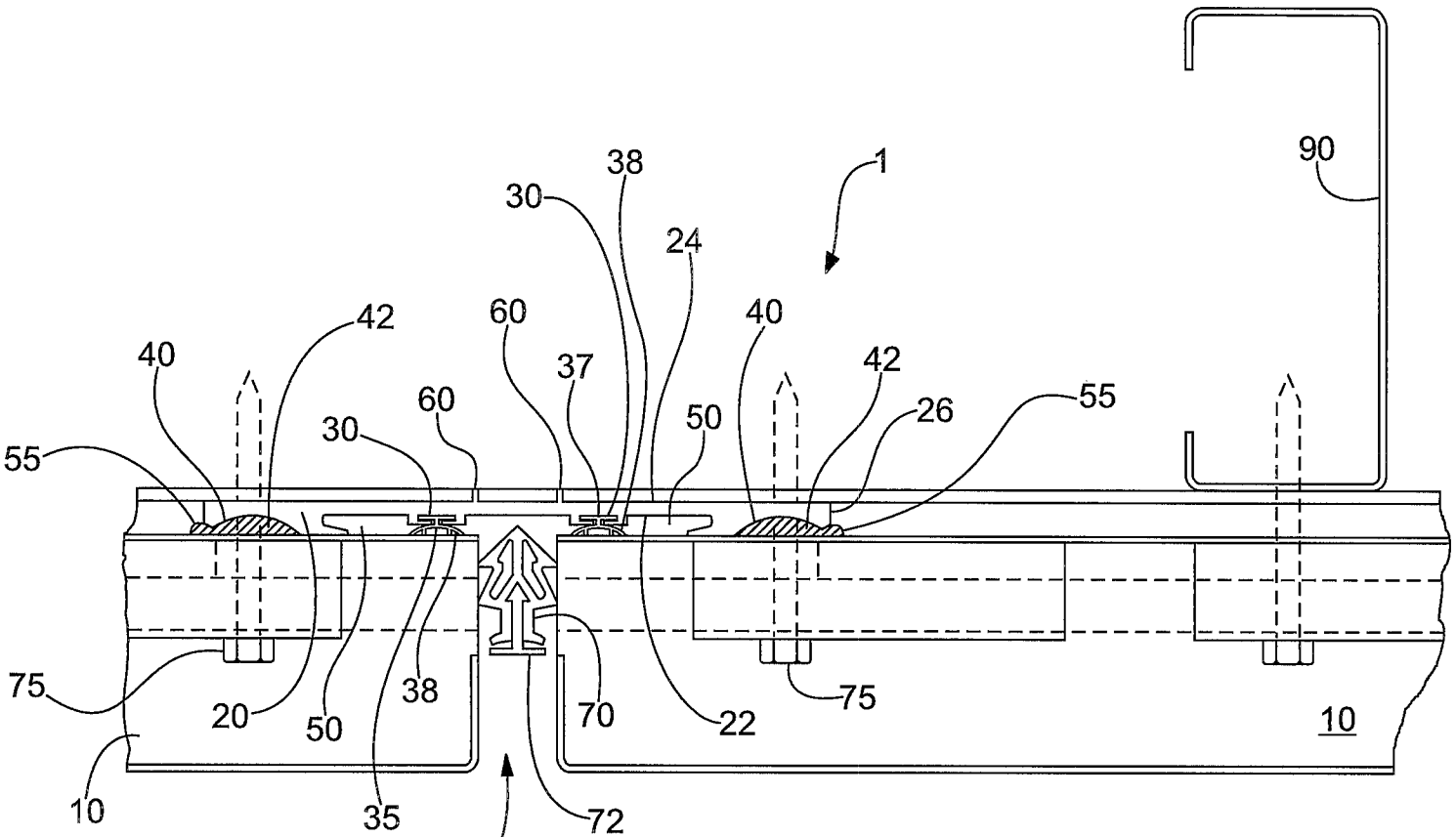
FIG. 4 is a cross-sectional view of the seal plate shown in FIG. 3 showing the seal plate secured to building panel end joints off of the stud line.

When transitioning between upper and lower building panels 10, connecting beads of sealant 42 are provided between the corresponding sealant receiving portions 40 of the upper and lower building panels 10 such that a continuous seal is provided for the vertical end joint 5 of the panels 10 (connecting beads of sealant and beads of sealant running the panel length are represented by dashed lines in FIGS. 2-4). Further, an exterior gasket 70 is positioned in the vertical end joint 5 between the two building panels 10. The exterior gasket 70 may include an insert 72 on the same side as the facing sheet 12 of the building panels 10, i.e., the insert 72 faces the exterior. The insert 72 may be made from any suitable material and may be provided with a range of colors to meet the design needs of the end user. The insert 72, therefore, provides alternative design options for the vertical end joints 5 beyond the standard black exterior gasket typically available.

The elongate body 20 is disclosed having a pair of gasket receiving portions 30 and a pair of sealant receiving portions 40 forming a symmetrical unitary member with a gasket receiving portion 30 and a sealant receiving portion 40 on each side of the elongate body 20. However, the elongate body 20 may be formed as two separate parts, with each part of the elongate body 20 including a gasket receiving portion 30 and a sealant receiving portion 40 with a channel 50 positioned therebetween. Each part of the elongate body 20 may be secured to the tubular support 85 via extension legs 65 extending from the separate parts of the elongate body 20.

In a further embodiment, shown in FIGS. 3 and 4, the seal plate assembly 1 is the same as that described hereinabove except the seal plate 1 does not include the extension legs 65 of the seal plate assembly 1 in connection with FIGS. 1 and 2. In particular, the seal plate assembly 1 shown in FIGS. 3 and 4 is configured to be attached to a stud 90 or ends of the panels 10, as opposed to being secured to the tubular support 85 as shown in FIGS. 1 and 2. The elongate body 20 shown in FIG. 3 is installed by securing the elongate body 20 to the stud 90 via a plurality of attachment fasteners 80 inserted through corresponding holes (not shown) in the elongate body 20 and the stud 90. Further, the elongate body 20 without the extension legs 65, as shown in FIG. 4, can be clamped to the ends of the panels 10 via the clamping screws 75 without being attached to the stud 90 or tubular support 85. Thus, a support, such as the tubular support 85 or the stud 90, is not required at the ends of the panels 10. The elongate body 20 shown in FIGS. 3 and 4 is also structural, as noted above, allowing the elongate body 20 to transfer fastener loads from the panels 10 to the stud 90 and also eliminating the need for grouped studs to catch the fastening points of each panel end on the elongate body 20.

Therefore, the seal plate assembly 1 shown in FIGS. 1-4 and described hereinabove provides a seal for vertical end joints 5 having two lines of defense for the intrusion of water. In particular, the elongate body 20 may have first and second seals on each side of the vertical end joint 5. The first seal may be the gaskets 35 provided in the gasket receiving portions 30 of the elongate body 20 to provide the first line of defense. The second seal may be the sealant 42 provided in the sealant receiving portions 40 to serve as the primary air and water seal and act as a second line of defense for the seal plate assembly 1. The channels 50 are vented to the exterior atmosphere to eliminate a pressure difference across the gaskets 35 to prevent water from being drawn across the gaskets 35. Further, the channels 50 are vented to a base and head detail to divert any moisture that may bypass the gaskets 35, as well as to equalize pressure to the exterior atmosphere. The channels 50 are outboard of the sealant 42 provided in the sealant receiving portions 40 such that the air tightness of the wall is not compromised by the seal plate venting.

Although the seal plate assembly 1 is shown having two gaskets 35 engaging the building panels 10, the seal plate assembly 1 may include a single gasket that is sized to engage adjacent building panels 10. Further, although the seal plate assembly 1 is shown having a pair of gasket receiving portions 30 and a pair of sealant receiving portions 40, the seal plate assembly 1 may include two pairs of gasket receiving portions 30 in place of the sealant receiving portions 40 and vice versa. The positioning of the gasket receiving portions 30 and the sealant receiving portions 40 may also be reversed from the positioning shown in FIGS. 1-4 such that the gasket receiving portions 30 are positioned inboard from the sealant receiving portions 40. The gasket receiving portions 30 and the sealant receiving portions 40 may also be embodied as substantially flat portions of the elongate body 20.

The relief gaps 55 along the longitudinal edges 26 of the elongate body 20 also provide relief for the sealant 42 and allow visual inspections of the seal plate assembly 1 to ensure that sufficient sealant 42 is provided in the sealant receiving portions 40. Moreover, the sealant receiving portions 40 allow the sealant 42 to flex more during thermal movement. Thus, the seal plate assembly 1 according to the present invention provides additional assurances that a proper seal of the vertical end joint 5 is obtained over typical sealing arrangements only utilizing a bead of sealant and a standard plate. Furthermore, the elongate body 20 is structural, allowing the elongate body 20 to transfer fastener loads from the panels 10 to the vertical structural supports and does not require an additional member to carry the load as typically used with standard gage steel seal plates.

While certain embodiments of the seal plate 1 were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A seal plate for building panels comprising:

an elongate body having a first side and a second side, the first side of the elongate body including at least one inner seal and first and second outer seals, the at least one inner seal positioned between the first and second outer seals, the first side of the elongate body defining first and second recessed channels extending at least a portion of a length of the elongate body, the first recessed channel positioned between the at least one inner seal and the first outer seal, the second recessed channel positioned between the at least one inner seal and the second outer seal, wherein the first and second recessed channels are adapted to communicate with an exterior atmosphere such that a pressure within the first and second recessed channels is equalized to the exterior atmosphere.

2. The seal plate of claim 1, wherein the first side of the elongate body defines first and second relief gaps, the first relief gap positioned adjacent a first longitudinal edge of the elongate body, the second relief gap positioned adjacent a second longitudinal edge of the elongate body.

3. The seal plate of claim 1, wherein the at least one inner seal comprises first and second elongate gaskets.

4. The seal plate of claim 3, wherein the first and second elongate gaskets are spaced from each other.

5. The seal plate of claim 1, wherein the elongate body comprises a metal plate configured to transfer loads from building panels to a support.

6. The seal plate of claim 1, further comprising a pair of spaced apart legs extending from the second side of the elongate body, each leg extending at least a portion of the length of the elongate body.

7. The seal plate of claim 1, further comprising a pair of spaced apart tab members extending from the second side of the elongate body, each tab member extending at least a portion of the length of the elongate body.

8. A seal plate assembly comprising:

first and second building panels each comprising a facing sheet, a backing sheet, and a foam core positioned between the facing sheet and the backing sheet, each building panel having a first side and a second side, the first building panel positioned adjacent to the second building panel to define a joint; and a seal plate comprising an elongate body having a first side and a second side, the first side of the elongate body including at least one inner seal and first and second outer seals, the at least one inner seal positioned between the first and second outer seals, the first side of the elongate body defining first and second recessed channels extending at least a portion of a length of the elongate body, the first recessed channel positioned between the at least one inner seal and the first outer seal, the second recessed channel positioned between the at least one inner seal and the second outer seal, the at least one inner seal and the first and second outer seals engaging at least one of the first and second building panels.

9. The seal plate assembly of claim 8, wherein the first and second recessed channels are adapted to communicate with an exterior atmosphere such that a pressure within the first and second recessed channels is equalized to the exterior atmosphere.

10. The seal plate assembly of claim 8, wherein the first side of the elongate body defines first and second relief gaps, the first relief gap positioned adjacent a first longitudinal edge of the elongate body, the second relief gap positioned adjacent a second longitudinal edge of the elongate body.

11. The seal plate assembly of claim 8, wherein the at least one inner seal comprises first and second elongate gaskets.

12. The seal plate assembly of claim 11, wherein the first and second elongate gaskets are spaced from each other.

13. The seal plate assembly of claim 8, wherein the elongate body comprises a metal plate configured to transfer loads from building panels to a support.

14. The seal plate assembly of claim 8, further comprising a pair of spaced apart legs extending from the second side of the elongate body, each leg extending at least a portion of the length of the elongate body.

15. The seal plate assembly of claim 8, further comprising a pair of spaced apart tab members extending from the second side of the elongate body, each tab member extending at least a portion of the length of the elongate body.

16. The seal plate assembly of claim 8, wherein the first and second outer seals comprise beads of sealant.

17. The seal plate assembly of claim 16, wherein the beads of sealant are received within respective sealant receiving portions, the sealant receiving portions extending at least a portion of the length of the elongate body.

* * * * *